US005189645A

United States Patent [19]

Innes

[11] Patent Number: 5,189,645

[45] Date of Patent: Feb. 23, 1993

[54] DOWNHOLE TOOL

[75] Inventor: Frank A. S. Innes, Bieldside, Great Britain

[73] Assignee: Halliburton Logging Services, Inc., Houston, Tex.

[21] Appl. No.: 786,640

[22] Filed: Nov. 1, 1991

[51] Int. Cl.[5] ..... G01V 1/40

[52] U.S. Cl. ..... 367/84

[58] Field of Search ..... 367/83, 84

[56] References Cited

U.S. PATENT DOCUMENTS

| | | | |
|---|---|---|---|
| 4,713,089 | 1/1973 | Claycomb | 367/84 |
| 4,785,300 | 11/1988 | Chin et al. | 367/84 |
| 4,847,815 | 7/1989 | Malone | 367/84 |
| 4,914,637 | 4/1990 | Goodsman | 367/84 |
| 4,956,823 | 9/1990 | Russell et al. | 367/84 |

*Primary Examiner*—Ian J. Lobo
*Attorney, Agent, or Firm*—William J. Beard

[57] ABSTRACT

A downhole tool for generating pressure pulses in a drilling fluid comprising an elongated body and a plurality of blades spaced around the body. The blades are each divided into an independent front section and rear section, forming a set of front sections and a set of rear sections, at least one of the set of front sections and the set of rear sections being mounted for rotation such that the front and rear sections are angularly displaceable relative to each other between a first position in which the sections are aligned and a second position in which the rear sections obstruct fluid flow between the front sections to generate a pressure pulse. The tool includes a means for generating a torque on the blade sections, and an escapement means which is radially movable to permit stepwise rotation of the blade sections, and thus to move the blade sections between the first and second positions. Each successive rotation of one of said sets of blade sections relative to the other of said sets of blade sections occurs in the opposite direction to the immediately preceding stepwise rotation of the said one set of blade sections relative to the said other set of blade sections.

5 Claims, 3 Drawing Sheets

DOWNHOLE TOOL

The invention relates to a downhole tool such as a well-logging tool, and more particularly to a tool of the measure-while-drilling (MWD) type.

When oil wells or other boreholes are being drilled it is frequently necessary to determine the orientation of the drilling tool so that it can be steered in the correct direction. Additionally, information may be required concerning the nature of the strata being drilled, the temperature or the pressure at the base of the borehole, for example. There is thus a need for measurements of drilling parameters, taken at the base of the borehole, to be transmitted to the surface.

One method of obtaining at the surface the data taken at the bottom of the borehole is to withdraw the drill string from the hole, and to lower the instrumentation including an electronic memory system down the hole. The relevant information is encoded in the memory to be read when the instrumentation is raised to the surface. Among the disadvantages of this method are the considerable time, effort and expense involved in withdrawing and replacing the drill string. Furthermore, updated information on the drilling parameters is not available while drilling is in progress.

A much-favoured alternative is to use a measure-while-drilling tool, wherein sensors or transducers positioned at the lower end of the drill string continuously or intermittently monitor predetermined drilling parameters and the tool transmits the appropriate information to a surface detector while drilling is in progress. Typically, such MWD tools are positioned in a cylindrical drill collar close to the drill bit, and use a system of telemetry in which the information is transmitted to the surface detector in the form of pressure pulses through the drilling mud or fluid which is circulated under pressure through the drill string during drilling operations. Digital information is transmitted by suitably timing the pressure pulses. The information is received and decoded by a pressure transducer and computer at the surface.

The drilling mud or fluid is used to cool the drill bit, to carry chippings from the base of the bore to the surface and to balance the pressure in the rock formations. Drilling fluid is pumped at high pressure down the centre of the drill pipe and through nozzles in the drill bit. It returns to the surface via the annulus between the exterior of the drill pipe and the wall of the borehole.

In a number of known MWD tools, a negative pressure pulse is created in the fluid by temporarily opening a valve in the drill collar to partially bypass the flow through the bit, the open valve allowing direct communication between the high pressure fluid inside the drill string and the fluid at lower pressure returning to the surface via the exterior of the string. However, the high pressure fluid causes serious wear on the valve, and often pulse rates of only up to about 1 pulse per second can be achieved by this method.

Alternatively, a positive pressure pulse can be created by temporarily restricting the flow through the downpath within the drill string by partially blocking the downpath.

U.S. Pat. No. 4,914,637 (Positec Drilling Controls Ltd) discloses a number of embodiments of MWD tool having a pressure modulator for generating positive pressure pulses. The tool has a number of blades equally spaced about a central body, the blades being split in a plane normal to the longitudinal axis of the body to provide a set of stationary half-blades and a set of rotary half blades. A temporary restriction in the fluid flow is caused by allowing the rotary half-blades to rotate through a limited angle, so that they are out of alignment with the stationary half-blades, the rotation being controlled by a solenoid-actuated latching means. In one embodiment, the drilling fluid is directed through angled vanes in front of the split blades in order to impart continuous torque to the rotary half-blades, such that the rotary half-blades rotate through a predetermined angle in the same direction each time the latch is released, thus being rotated successively into and out of alignment with the stationary half-blades. The rotary blades are mechanically linked to a rotatable cylindrical housing via a central shaft. The latching or escapement means comprises an axially slidable actuator rod having detent means extending perpendicularly thereto, the detent means engaging successive pins protruding from the interior of the cylindrical housing as the rod slides between two axial positions, allowing the housing to rotate through a predetermined angle.

In U.S. Pat. No. 4,914,637, because the rotary half blades always move in the same direction with respect to the stationary half blades, a scissor action occurs between the leading edge of the rotary half blades and the trailing edge of the stationary half blades at the interface between the half blades, as the rotary half blades move from the position where they are out of alignment with the stationary half blades to the aligned position of the next stationary half blade. Thus any debris or other foreign matter which finds its way into the drilling mud, may be caught at the interface of the blades as this scissor action occurs and thus jam the whole tool, or cause considerable damage to the blades. The present invention aims to overcome this disadvantage, by providing a means of moving the either one or both of the two sets of half blades such that each successive incremental rotation of one set of half blades relative to the other set of half blades occurs in the opposite direction to the previous incremental rotation relative to the other set of half blades.

Additionally, the latching means of U.S. Pat. No. 4,914,637 is actuated by movement of the detent means in the axial direction only, and the pins and the detent means are subject to considerable torque as the housing reaches the end of its rotation and the detent means engages the next successive pin. Accordingly, the detent means requires a substantial support on the slidable actuator rod to withstand the torque, and the pins and the detent means are susceptible to significant wear and stress. An embodiment of the present invention provides an escapement means which is actuated by radial movement of the detent means, such that the torque exerted on the escapement means is considerably reduced, and the escapement means does not require such a bulky and substantial support on the actuator rod.

Furthermore, the mechanical linkage between the rotary blades and the latching means in U.S. Pat. No. 4,914,637 is complex and includes a number of torque transfer points where stress and ultimate failure of the device may occur. In a preferred embodiment, the present invention aims to provide a much more direct linkage between the latching or escapement means and the rotary blades.

EP-A-0325047 (Russell et al) describes a measure-while-drilling tool employing a turbine with curved impeller blades, wherein the impeller rotates continuously under the action of the high pressure downward flow. Each impeller blade is split into two portions in a plane normal to the axis of rotation of the impeller. An electric generator is driven by the impeller assembly and one portion of the impeller blade is capable of limited angular displacement relative to the other portion about the axis of rotation in response to a change in the load of the generator. When the two portions of the impeller blade are out of normal alignment, they provide increased resistance to the flow of the drilling fluid, so that as the angular displacement of the one portion varies with respect to the other portion, so will the pressure drop across the impeller assembly. The restoring force for returning the one portion of the impeller blades to normal alignment with the other portion is provided by a spring or an elastomeric seal: if the restoring force is too weak a large pressure pulse can be developed, but there is a long delay before the portions are realigned so that the pressure pulse rate can only be very low. If the restraining force is too great the pulse rate can be sufficiently rapid for efficient data transmission, but the pressure pulses will be much weaker. Furthermore, the blades cannot be retained in the non-aligned position for long as there will be a natural tendency for the blade portions to realign.

According to the present invention there is provided a downhole tool for generating pressure pulses in a drilling fluid, the tool comprising an elongate body for positioning in a drill collar of a drill string; a plurality of blades spaced around said body, each blade being divided into an independent front section and rear section, forming a set of front sections and a set of rear sections, at least one of said sets being mounted for rotation such that said front and rear sections are angularly displaceable relative to one another between a first position in which the sections are aligned and a second position in which the rear blade sections obstruct the fluid flow between the front sections to generate a pressure pulse; means whereby a torque is developed on the blade sections; and escapement means to permit stepwise rotation of the blade sections between said first and second positions; characterised in that each successive stepwise rotation of one of said sets of blade sections relative to the other of said sets of blade sections occurs in the opposite direction to the immediately preceding stepwise rotation of the said one set of blade sections relative to the said other set of blade sections.

In one preferred embodiment of the invention, both the set of front blade sections and the set of rear blade sections are mounted for rotation such that said rear sections are rotatable in one direction from the first to the second position, and said front sections are subsequently rotatable in said one direction from said second to said first position.

Preferably, the blade sections are mounted on a rotatable member and the escapement means are radially movable to alternately engage and disengage with teeth on the rotatable member; and the movement may be in response to camming means. The escapement means are preferably supported in longitudinal slots in a stationary sleeve positioned within the rotatable member.

In one embodiment, the escapement means comprise at least one pin, disposed in each said slot, the pin being radially movable in response to the camming means, the camming means preferably being operable by an electric actuator such as a solenoid.

The torque may be developed by means of the front and rear blades, which may be curved to act as lifting sections. The rear blade sections preferably each have a generally planar forward end surface extending generally normal to the direction of fluid flow.

An embodiment of the invention will now be described in greater detail by way of example with reference to the accompanying drawings, in which.

Figure 1:
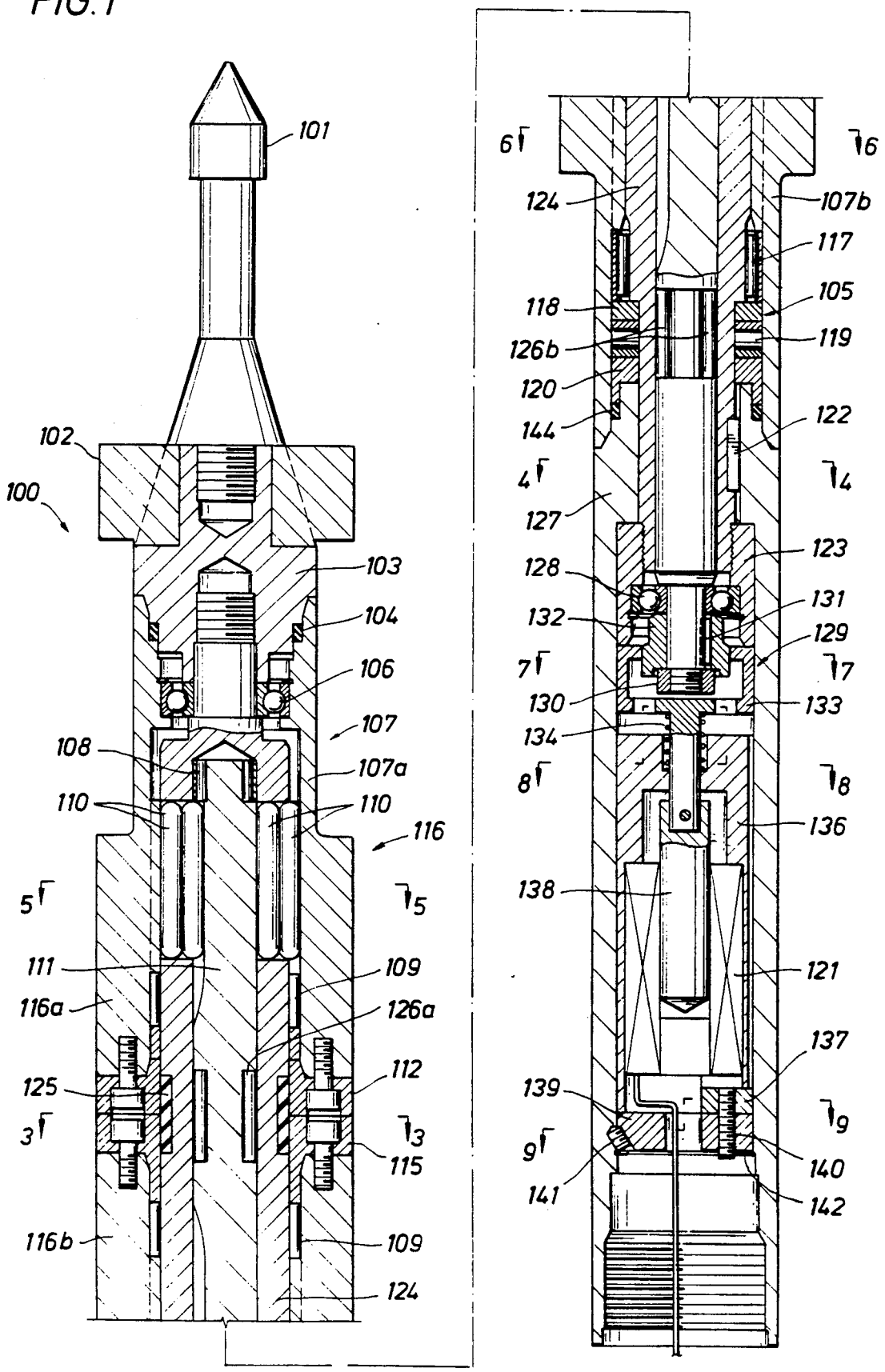
FIG. 1 is a longitudinal cross-section of an embodiment of a downhole tool for generating pressure pulses in a drilling fluid.

A preferred embodiment of the invention is shown in FIG. 1. A downhole tool, generally indicated by reference numeral 100 has a streamlined casing 103 facing into the downward flow of drilling fluid. A standard fishing end 101 extends from the casing, and permits the tool to be manipulated or to be retrieved should the tool need to be brought to the surface. A downhole filter 102 consisting of a series of radial vanes is fitted to the casing 103 in order to centralise it in the drill collar. A rotatable sleeve 107 extends downstream of the casing, and a stationary inner sleeve 124 extends coaxially with the rotatable sleeve 107. Towards its upstream end, the rotatable sleeve is sealed against the casing 103 by a rotary spring-loaded lip seal 104, and is supported on the inner sleeve by deep groove ball bearings 106. Towards its downstream end, the rotatable sleeve is sealed against an escapement housing 127 by a rotary spring-loaded lip seal 144, and is supported on the inner sleeve by a bearing assembly 105, while the escapement housing 127 is held fast with the inner sleeve by means of a locking key 122. The lip seals 104 and 144 prevent ingress of drilling fluid to the bearing 106 and bearing assembly 105 respectively. The bearing assembly 105 comprises a needle roller bearing 117, a bush spacer 118, a thrust bearing 119 and a thrust bearing support ring 120.

Figure 2:
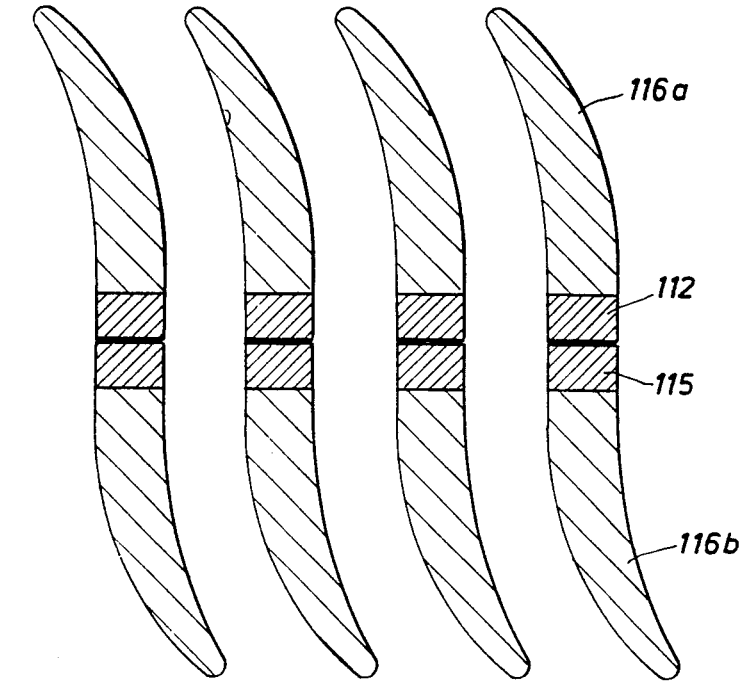
FIG. 2 shows detail of the blade arrangement on the tool of FIG. 1.

The rotatable sleeve 107 has formed thereon a number of blades 116, each blade comprising a front blade section **116*a* and a rear blade section 116*b*. The rotatable sleeve is split in a plane normal to the longitudinal axis of the tool such that the rear portion 107*b* of the rotatable sleeve and the front portion 107*a* of the rotatable sleeve can rotate relative to each other, and thus the rear blade section 116*b* and the front blade section 116*a* can rotate relative to each other. When the front and rear blade sections are aligned they form a set of curved streamlined blades, between which the drilling fluid can flow with a low drag coefficient. The shape of each aligned blade can be seen more clearly in FIG. 2**. When the relative rotation of the front and rear blade sections is such that the rear blade sections lie in a position of maximum misalignment with respect to the front blade sections, the drag coefficient is greatly increased, and a pressure pulse is transmitted through the drilling fluid.

The blades 116 are curved relative to the direction of flow of the drilling fluid, such that the resulting lift component acting one the blades tends to rotate sleeve 107 on its bearings about the inner sleeve 124. Thus a continuous torque is supplied to the blade sections 116*a* and 116*b*, and the main driving force for creating the pressure pulses is derived directly from the energy in the drilling fluid, so that the additional energy requirement from downhole batteries or a turbine is very low.

Each front blade section has a generally planar rear end layer 112 extending generally normal to the direction of fluid flow and each rear blade section has a generally planar forward end layer 115 extending generally normal to the direction of fluid flow. These rear and forward end layers 112 and 115 form adjacent faces of the blade sections when the blade sections are aligned, and comprise a wear resistant material which reduces abrasion of the faces of the blade sections. They also retain lip seals in the sleeves 107. Additional needle roller bearings 109 support the front and rear blade sections of the rotatable sleeve on the inner sleeve 124, and a rubber collar 125 is provided in an annular recess on the inner sleeve in longitudinal alignment with the split in the rotatable sleeve, to withstand erosion due to turbulence in that area.

Figure 4:
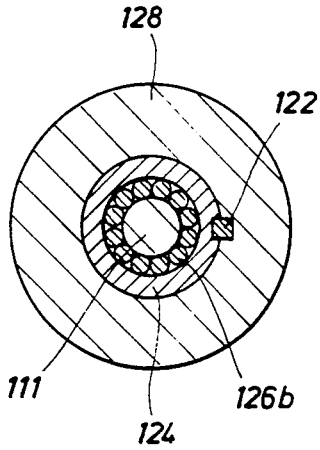
FIG. 4 is a section taken on line D—D of FIG. 1.
Figure 3:
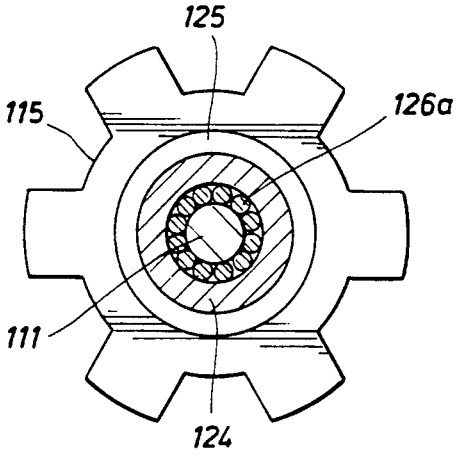
FIG. 3 is a section taken on line C—C of FIG. 1.

A cam shaft 111 is received within the inner sleeve 124 such that it can rotate coaxially within the inner sleeve on needle roller bearings 108 at the forward end of the cam shaft and on deep groove ball bearings 128 at the downstream end of the cam shaft. The ball bearings 128 are mounted between the cam shaft and a retaining nut 123 which supports the escapement housing 127 on the inner sleeve 124. Two additional sets of needle roller bearings 126*a* and 126*b* are provided along the length of the cam shaft 111, one of these sets of needle roller bearings 126*a* being longitudinally aligned with the collar 125. Thus FIG. 3 shows a cross-section of the tool taken on line more clearly in FIG. 4.

An escapement mechanism 129 is provided on the downstream end of the cam shaft. The escapement mechanism is held on the cam shaft by means of a nut 130 and is locked to the camshaft by means of a key 131. The escapement mechanism comprises a ratchet 132 and a pawl 133, the pawl being operable to move longitudinally backward and forward into and out of engagement with the ratchet 132. The pawl is linked to a plunger 138 of a tubular solenoid 121, and a return spring 134 also acts on the pawl, such that the solenoid pulls the plunger and hence the pawl in one direction, and the spring 134 provides the return force in the opposite direction. The solenoid is held within a solenoid canister 136, which is provided with a free adjustment ring 137 and a fixed adjustment ring 139. A pin 140 sets the relative position of the adjustment rings, and a fixing pin 141 secures the fixed ring to the housing wall.

Figure 5:
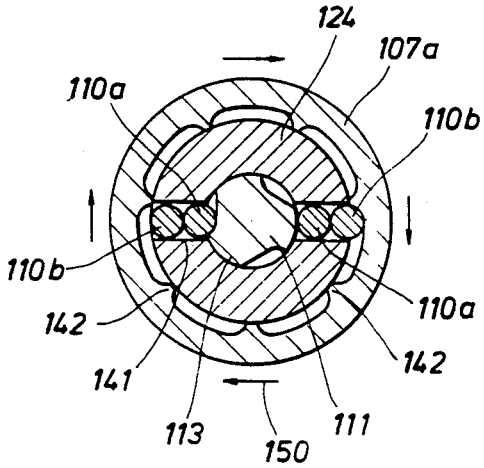
FIG. 5 is a section taken on line A—A of FIG. 1.
Figure 6:
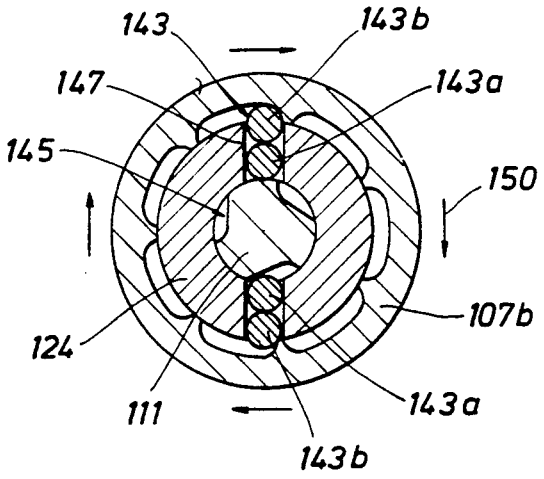
FIG. 6 is a section taken on line B—B of FIG. 1.

FIGS. 5 and 6 are cross-sectional views of the tool taken on line A—A and line B—B respectively. For the sake of clarity, the rotatable sleeve 107 has been shown without the blades 116 in FIGS. 5 and 6. Referring first to FIG. 5, the cam shaft 111 is provided with three lugs 113 spaced equi-angularly around its circumference. The inner sleeve 124 has two diametrically opposed longitudinal slots 114 in each of which are positioned two escapement rollers 110. The front portion 107*a* of the rotatable sleeve has internally projecting teeth 142. As the cam shaft rotates, a lug 113 engages an inner roller 110*a* and cams it outwards, thus also camming outer roller 110*b* outwards such that it protrudes beyond the outer edge of inner sleeve 124 and into the path of internal teeth 142 on rotatable sleeve 107*a*. Thus, as sleeve 107*a* rotates under the constant torque an internal tooth 142 engages outer roller 110*b* and further rotation is prevented until the cam shaft is moved on.

As shown in FIG. 6, a similar arrangement is provided to control the movement of the rear portion 107*b* of the rotatable sleeve. Escapement rollers 143 are positioned in longitudinal slots 147 in the inner sleeve 124. The cam shaft is provided with three equi-spaced lugs 145, and the rotatable sleeve has internally projecting teeth 146. The slots 147 in the rear portion of the rotatable sleeve are circumferentially displaced through an angle of 90° with respect to the slots 114 in the front portion of the rotatable sleeve.

In the position shown in FIGS. 5 and 6, both the front and the rear portion of the rotatable sleeve are locked against rotation. The continuous torque supplied to both portions by means of the curvature of the blades tends to rotate the portions of the rotatable sleeve clockwise as shown by the arrows 150, but the cam shaft 111 is held in a position where one of the lugs 113 engages one of the sets of escapement rollers 110 such that an outer roller 110*b* cooperates with the forward edge of a tooth 142 and prevents rotation of front portion 107*a* of the rotatable sleeve, and hence of front blade section 116*a*. With the cam shaft 111 held in that position one of the lugs 145 engages the inner roller 143*a* of one of the sets of escapement rollers 143 such that an outer roller 143*b* cooperates with the forward edge of a tooth 146 and prevents rotation of rear portion 107*b* of the rotatable sleeve, and hence of rear blade section 116*b*.

The camshaft escapement mechanism is then operated to release the cam shaft, as will be described in more detail hereinafter. The rear portion 107*b* of the rotatable sleeve, trying to rotate clockwise, exerts a torque on the cam shaft by means of the escapement rollers 143, as can be seen in FIG. 6. Thus, when the cam shaft is freed, it rotates clockwise through an angle of approximately 30°, and as the rollers 143 move inwards the rear portion of the rotatable sleeve is free to rotate until an internal tooth 146 engages with the other, diametrically opposed set of escapement rollers 143. The cam shaft is then held stationary: in this resultant position front portion 107*a*, in trying to rotate clockwise, is exerting a torque on the cam shaft by means of the escapement rollers 110. When the cam shaft is released by means of escapement mechanism 129, it again rotates clockwise through an angle of approximately 30°, and as the rollers 110 move inwards, the front portion of the rotatable sleeve is free to rotate until an internal tooth 142 engages the other set of rollers 110. The cam shaft is locked in a stationary position once more.

Controlling the movement of the cam shaft to rotations in steps of 30°, controls the movement of the rotatable sleeve to incremental steps of rotation. The rear portion 107*b* moves clockwise through a predetermined angle and then the front portion 107*a* moves through that angle in the same direction, such that rear blade portions 116*b* move from a position where they are aligned with the front blade portions to a position of maximum misalignment, and then the front blade portions 116*a* move from the misaligned position back into alignment with the rear blade portions, i.e. the rear blade portions move out of alignment when the cam shaft is released and then the front blade portions move to catch them up the next time the camshaft is released.

Alternative embodiments of the invention are envisaged, wherein the rear blade portions move, for example, clockwise to a position out of alignment with the front blade portions, and then when the rotatable sleeve is next free to move, the rear blade portions move anti-clockwise back into alignment with the front blade portions in their original position.

When the rotatable sleeve is stopped by an escapement roller, the stopping force is spread over the length of the roller, and is absorbed by the sides of the slots which hold the rollers, so that this pulser escapement means is very hard wearing.

Figure 7:
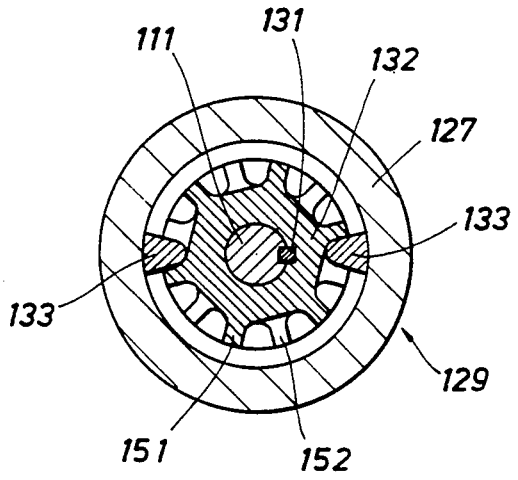
FIG. 7 is a section taken on line E—E of FIG. 1.

Referring also to FIG. 7, which shows the cam shaft escapement mechanism 129 in more detail, the ratchet 132 comprises a front toothed ratchet wheel 151 and a rear toothed ratchet wheel 152. Each ratchet wheel has six equi-spaced teeth on its circumference, and the rear wheel is held with respect to the front wheel with its teeth 30° out of alignment with the teeth of the front wheel. The front and rear ratchet wheels may be formed as an integral unit. In the position shown in FIGS. 1 and 7, the pawl 133 engages teeth on the front ratchet wheel 151 and the cam shaft is held stationary. When the solenoid operates to retract the plunger 138, and the pawl 133, the front ratchet wheel is released and the cam shaft is free to rotate through 30° until the next successive tooth of the rear ratchet wheel engages with the pawl 133. When the solenoid is deactivated, the spring 134 acts to return the plunger 138 to its original position, so that the cam shaft is free to rotate through a further 30° until the next successive tooth of the front ratchet wheel engages with the pawl 133. Thus the cam shaft is controlled to rotate stepwise in incremental angles of 30°.

Figure 8:
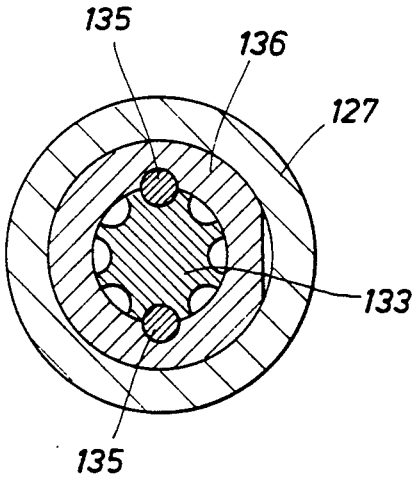
FIG. 8 is a section taken on line F—F of FIG. 1.

As shown in FIG. 8, the pawl 133 is prevented from turning and is slidably guided by pins 135 which are attached to the solenoid canister 136.

Figure 9:
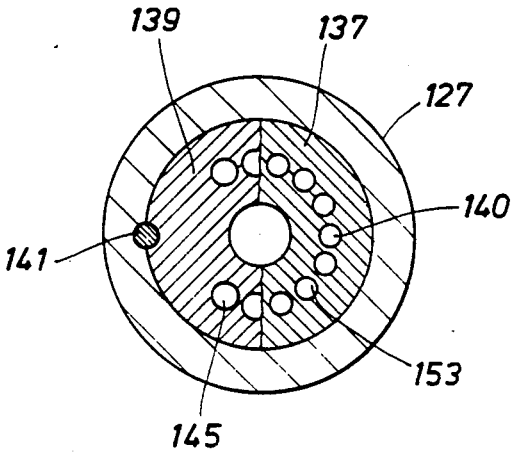
FIG. 9 is a section taken on line G—G of FIG. 1.

FIG. 9 shows a means for adjusting the assembly so that the fail-safe position, where the blade portions are aligned, is achieved. The fixed and free adjusting rings 139 and 137, have holes drilled to allow ±5° of adjustment. The holes 153 in the free ring are 25° apart, and the holes 154 in the fixed ring are 24° apart. The adjustment pin 140 sets the position of the free ring 137 with respect to the fixed ring 139.

Preferably, means are provided for reducing torsional vibration of the rotatable sleeve by a damping fluid such as oil contained within the rotatable sleeve.

I claim:

1. A downhole tool for generating pressure pulses in a flowing column of drilling fluid in a drill string wherein the tool comprises:

(a) an elongate body adapted to be positioned in a drill collar at the lower end of a drill string exposed to drilling fluid flow in the drill string;

(b) a first set of blades supported on a cylindrical housing about said body wherein said blades have an angle of attack which enables flowing drilling fluid to interact therewith and create rotation for said blades in a first direction relative to said body;

(c) a second set of blades supported on a second cylindrical housing about said body and spaced rearwardly on said body from said first set of blades, and wherein said second set of blades has an angle of attack to impart rotation to said second blades and said cylindrical housing in the same direction as the first set of blades;

(d) an electrically operated solenoid in said body responsive to a signal for forming a pressure pulse in the column of drilling fluid;

(e) locking means connected to said solenoid and extending from said solenoid to releasably lock said first and second blades in relatively altered positions, said positions defining first and second positions and further wherein said first position provides a streamlined flow path through the first and second sets of blades, and the second position defines a restricted drilling fluid flow path wherein fluid flow restriction is changed as a result of relative positioning of said first and second blades considered jointly; and (f) wherein said first and second positions form pressure pulses in the drilling fluid as a result of operation of said solenoid.

2. The apparatus of claim 1 wherein said solenoid enables controlled movement relatively between said first and second blades; and including means limiting said first and second blades to said first and second positions for timed intervals.

3. The apparatus of claim 2 wherein said limiting means moves said blades relatively to said first and second positions and said blades are held at said positions by locking means.

4. The apparatus of claim 3 wherein said locking means includes a set of teeth and means locking against said teeth, said teeth being spaced to define relative movement equal to the relative change between said first and second positions.

5. A downhole tool for generating pressure pulses in a drilling fluid in a drill string terminating a drill collar at the lower end wherein the tool comprises:

(a) an elongate body adapted to be positioned in the lower end of the drill string;

(b) a plurality of evenly spaced blades around said body wherein the blades have a leading end and a trailing end, and said blades are defined by separate leading and trailing sections independently mounted so that the leading and trailing sections rotate about said body as separate units;

(c) said leading section incorporates a blade constructed and arranged to intercept flowing drilling fluid in the drill string and thereby impart rotation as a result of axial fluid flow in the drill string in a first direction about said body;

(d) and further wherein said trailing section is constructed and arranged to impart rotation to said trailing section in the common direction as said leading section so that said trailing section rotates about said body in the same direction as said leading section;

(e) independent bearing means mounting said leading section for rotation about said body;

(f) independent bearing means mounting said trailing section for rotation about said body;

(g) releasable lock means for locking said trailing section blades so that said trailing section blades are spaced relative to said leading section blades for streamlined flow of drilling fluid adjacent to said elongate body, and also operatively locking said trailing section blades in response to an electrical signal applied to a solenoid means; and (h) said solenoid means electrically switches on and off to alternate the relative position of said trailing sections and thereby increase or decrease fluid flow pass said elongate body to create a pressure pulse in the drilling fluid thereabove and form a pressure pulse.

* * * * *